US008001909B2

(12) United States Patent
Overgaard et al.

(10) Patent No.: US 8,001,909 B2
(45) Date of Patent: Aug. 23, 2011

(54) TELESCOPIC LIFTING COLUMN FOR HEIGHT ADJUSTMENT OF ELEVATABLE TABLES

(76) Inventors: Michael Overgaard, Odense (DK); Gert Godvig Lassen, Skjern (DK); Jesper Ostergaard Kristensen, Skjern (DK)

( * ) Notice: Subject to any disclaimer, the term of this patent is extended or adjusted under 35 U.S.C. 154(b) by 497 days.

(21) Appl. No.: 12/160,830

(22) PCT Filed: Oct. 6, 2006

(86) PCT No.: PCT/DK2006/000562

§ 371 (c)(1),
(2), (4) Date: Jul. 14, 2008

(87) PCT Pub. No.: WO2007/112738

PCT Pub. Date: Oct. 11, 2007

(65) Prior Publication Data

US 2011/0023758 A1 Feb. 3, 2011

(30) Foreign Application Priority Data

Feb. 10, 2006 (DK) ..... 2006 00200

(51) Int. Cl.
*A47B 9/00* (2006.01)

(52) U.S. Cl. ..... 108/147; 248/404

(58) Field of Classification Search ..... 108/147, 108/144.11, 147.11, 147.19, 148, 147.21; 248/404, 161, 188.4, 188.2, 421, 422, 162.1, 248/188.5

See application file for complete search history.

(56) References Cited

U.S. PATENT DOCUMENTS

| | | | | | |
|---|---|---|---|---|---|
| 46,599 | A * | 2/1865 | Thorton | 108/147 |
| 1,243,750 | A * | 10/1917 | Miller | 108/147 |
| 1,292,470 | A * | 1/1919 | Hubschmitt, Jr. et al. | 108/147 |
| 4,590,865 | A * | 5/1986 | Rutsche et al. | 108/147 |
| 4,604,955 | A * | 8/1986 | Fleischer et al. | 108/147 |
| 5,289,782 | A * | 3/1994 | Rizzi et al. | 108/147 |
| 5,370,063 | A * | 12/1994 | Childers | 108/147 |
| 5,408,940 | A * | 4/1995 | Winchell | 108/147 |
| 5,549,053 | A * | 8/1996 | Grout | 108/147 |
| 6,345,547 | B1 * | 2/2002 | Stoelinga et al. | 108/147 |
| 6,435,111 | B1 * | 8/2002 | Stumpf | 108/147 |

(Continued)

FOREIGN PATENT DOCUMENTS

DE 3314388 A1 * 5/1984

(Continued)

*Primary Examiner* — Jose Chen
(74) *Attorney, Agent, or Firm* — Dennison, Schultz & MacDonald

(57) ABSTRACT

A telescopic lifting column for height adjustment of elevatable tables (1) consists of a stationary rectangular profile (2), which at the bottom rests against a floor, and of a sliding quadrangular profile (3), which slides inside the stationary profile (2) and which can be activated up or down by a linear actuator (4) and which at the top rests against a table top (7). The profiles (2, 3) each have an open side (resp. 8 and 9), and the linear actuator is embodied as a toothed rack (10), which is fastened to the internal side (3') of the sliding profile (3) opposite the open side (9), and which is in mesh with a toothed wheel (11), which is coupled to a gear motor (12,13), which is fastened to the stationary profile (2) of the lifting column. On the side facing the open side (9), the toothed rack (10) is embodied with a guide way (18) with a width (a) in which two guide pins (19, 20)—with a mutual distance (b) and fastened to the stationary profile (2)—are in mesh.

9 Claims, 12 Drawing Sheets

U.S. PATENT DOCUMENTS

| | | | | |
|---|---|---|---|---|
| 6,510,803 | B1 * | 1/2003 | Agee | 108/147 |
| 7,049,728 | B2 | 5/2006 | Bastholm | |
| 7,743,716 | B1 * | 6/2010 | Burka | 108/147 |

FOREIGN PATENT DOCUMENTS

| | | | |
|---|---|---|---|
| DE | 3303193 | | 8/1984 |
| DE | 3735663 | A1 * | 5/1989 |
| DE | 9213553 | | 1/1993 |
| EP | 30365 | A2 * | 6/1981 |
| EP | 0790420 | | 6/2000 |
| FR | 1374258 | | 8/1964 |
| SE | 458583 | | 4/1989 |
| WO | WO 9419987 | A1 * | 9/1994 |

* cited by examiner

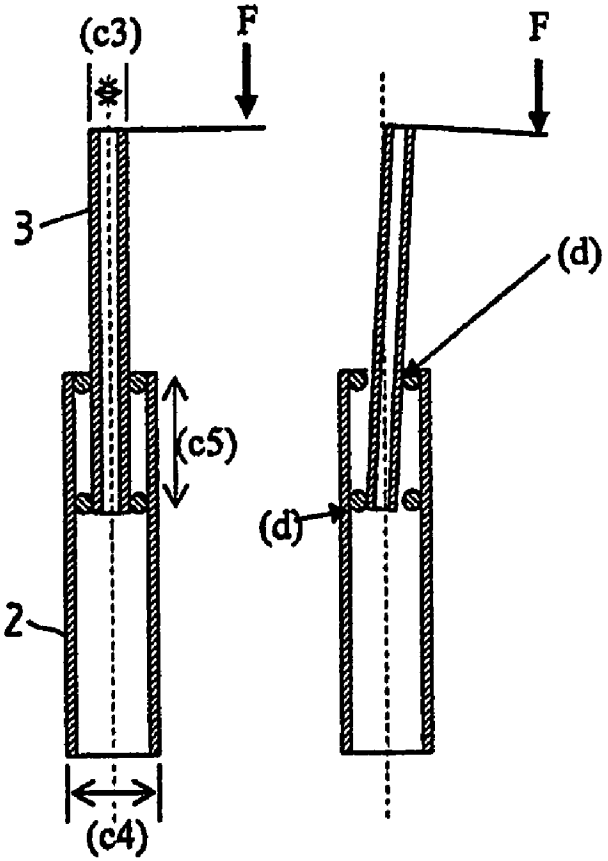
FIG.11
FIG.12
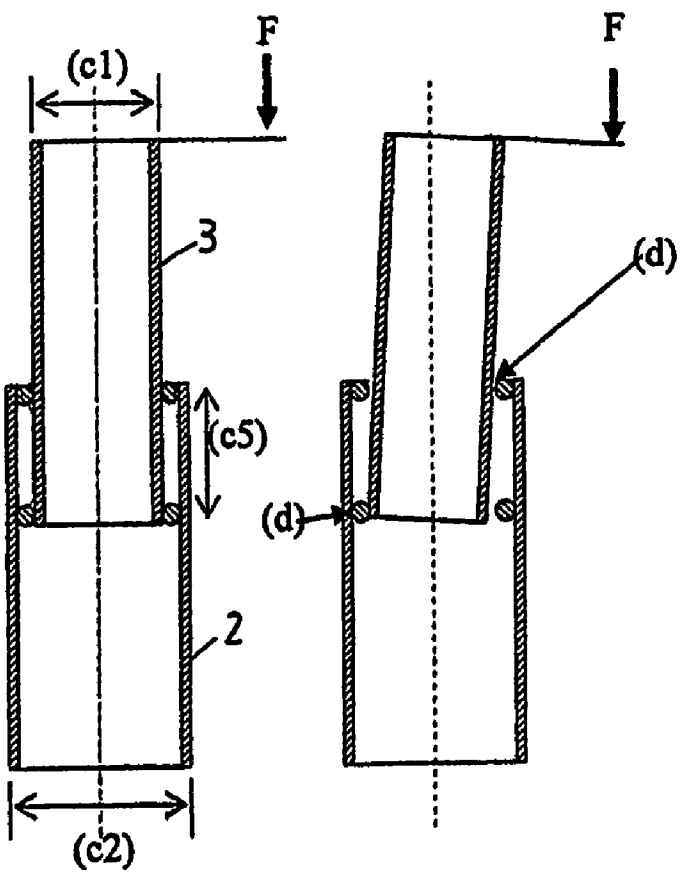
FIG.9
FIG.10

TELESCOPIC LIFTING COLUMN FOR HEIGHT ADJUSTMENT OF ELEVATABLE TABLES

The present invention relates to a telescopic lifting column of the kind described in the introductory part of claim 1.

As described in detail below there are various drawbacks in connection with the known telescopic lifting columns. In order to achieve the necessary bending stability the telescopic profiles must have a large cross-sectional dimension. Furthermore, as very accurate tolerances are required the production costs will be correspondingly higher. When the sliding telescopic profile is in its maximum lifting position, the bending moment from the table top will cause irregularities on the surface of the sliding profile. The friction between the profiles in this position will be great. There may also be a wedging effect. The driving motor in the linear actuator, which moves the sliding profile in relation to the stationary profile, must therefore have a correspondingly high effect.

It is a purpose of the present invention to describe a telescopic lifting column which does not have the said drawbacks of the known telescopic lifting columns.

This is achieved by embodying the telescopic lifting column as described in the characterising part of claim 1.

Claim 2 describes a preferred embodiment of the profiles for a telescopic lifting column according the invention.

By the arrangement described in claim 3 it is obtained that the friction between the guide pins and the guide way in the toothed rack in a telescopic lifting column according to the invention can be reduced.

By the arrangement described in claim 4 it is obtained that the bending stress on the toothed rack, and thereby also on the sliding quadrangular profile, will be greatly reduced.

By the arrangement described in claim 5 the guide pins and the gear motor are easily mounted and dismounted.

By the arrangement described in claim 6 the primary linear control by the guide pins is supplemented, when the overlap between the stationary and the sliding profile is large.

By the arrangement described in claim 7 the internal space in the stationary profile will be opened.

The invention will be described in detail below with reference to the drawing, in which FIG. 1 is a schematic front view of an elevatable table with two telescopic lifting columns.

FIG. 9 shows a schematic section in a known lifting column.

FIG. 10 is a picture corresponding to the one in FIG. 9 in which the upper sliding part is turned in relation to the bottom stationary part, when it is exposed to an eccentric load.

FIG. 11 is a picture corresponding to the one in FIG. 9 in which the stationary and the sliding parts have a smaller diameter.

FIG. 12 is a picture corresponding to the one in FIG. 11 in which the sliding part is turned in relation to the stationary part when the latter is exposed to an eccentric load.

FIG. 18 is a larger scale view of a detail C in FIG. 17.

FIG. 19 is a larger scale view of a detail B in FIG. 17.

Figure 1:
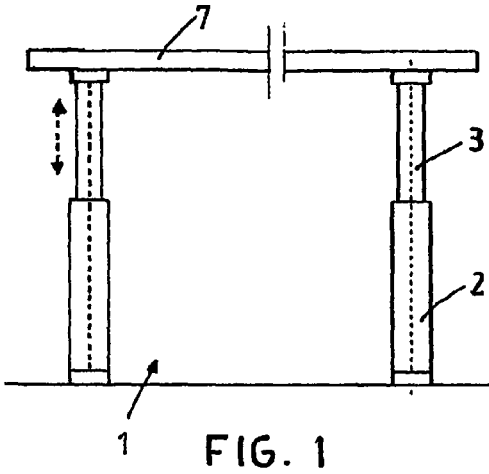

FIG. 1. is a frontal view of an elevatable table in its top position with two telescopic lifting columns.

Figure 2:
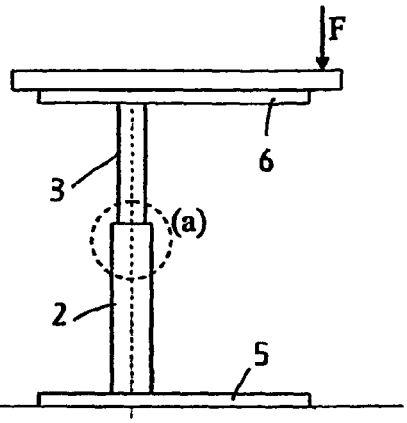
FIG. 2 shows the elevatable table seen from the end.
Figure 3:
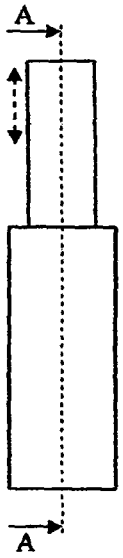
FIG. 3 is a schematic view of a known lifting column seen from the outside.
Figure 4:
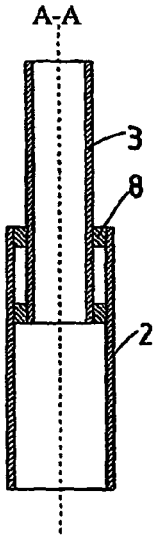
FIG. 4 shows a section after the line A-A in FIG. 3.
Figure 5:
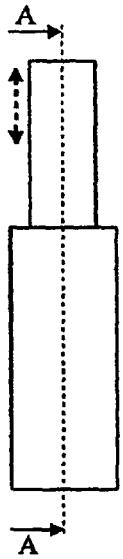
FIG. 5 is a schematic view of another known lifting column seen from the outside.
Figure 6:
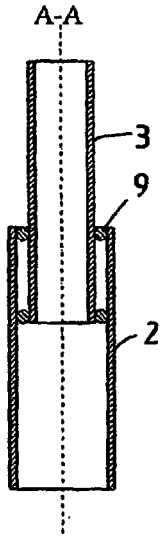
FIG. 6 shows a section after the line A-A in FIG. 5.
Figure 7:
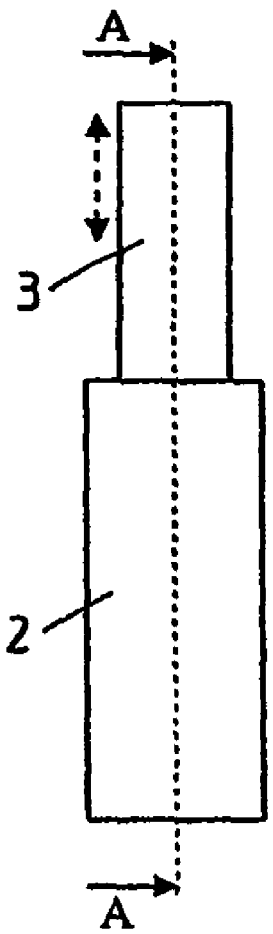
FIG. 7 is a schematic view of a known lifting column seen from the outside.

FIG. 2 shows the same table seen from the side. The force F is the force, which the user applies to the table, when he is working at the table or examining its stability. The force F causes a critical bending moment M in the area a, where the fixed and movable parts slide in each other.

The known technology employs closed telescopic profiles, which slide in each other either via sliding shoes 8 or balls 9. There is normally a motor in each leg, which drives a spindle inside the profiles. This spindle provides the motion between the profiles, but does not contribute to resistance against the bending moment.

The known technology demands a high degree of production accuracy of the closed telescopic profiles and/or fine adjustment of each individual telescopic lifting column, which in combination causes high costs of production. In addition, sliding shoes and balls will after some time develop distinct wear marks on the movable telescopic profile, which is a visible part of the piece of furniture.

Figure 8:
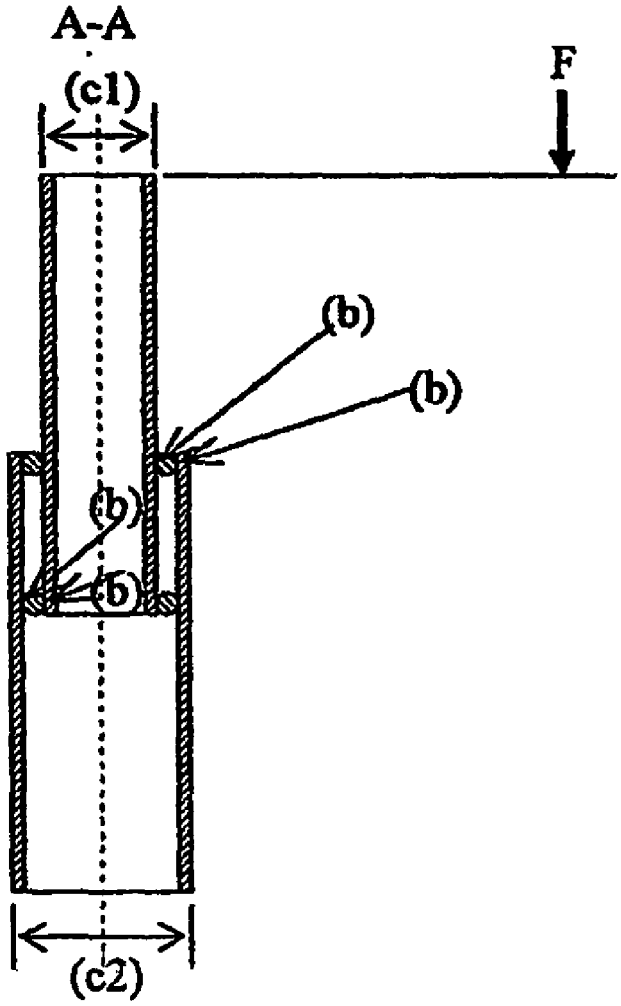
FIG. 8 shows a section after the line A-A in FIG. 7 with an added load on a belonging table top.
Figure 13:
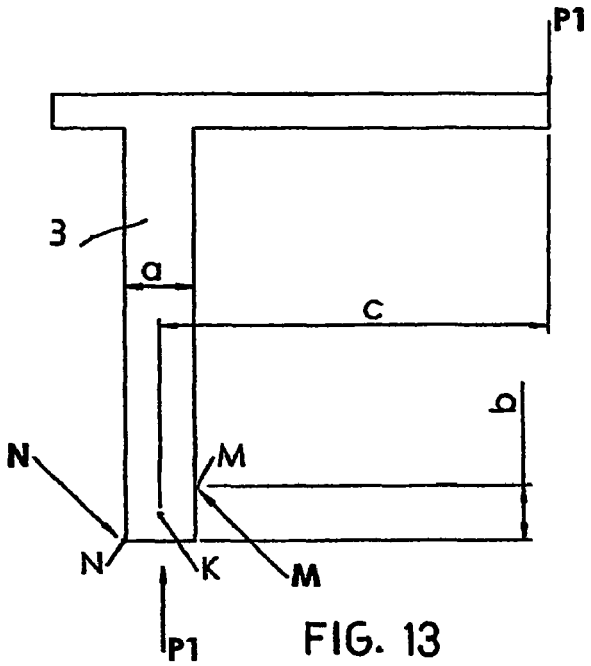
FIG. 13 is a schematic view of a table top attached to a sliding part of a lifting column, and which is marked with inscribed power loads and moments.
Figure 14:
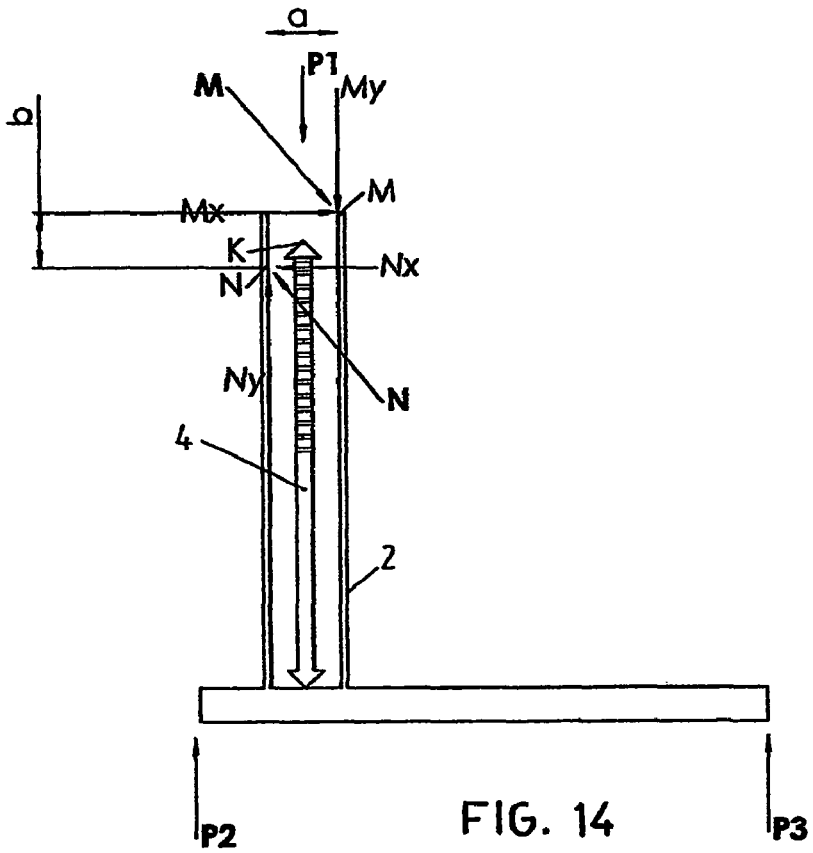
FIG. 14 is a corresponding picture of the stationary part of the lifting column.

When the force F acts on the table in its top position there occurs a pressure at the points b as shown in FIG. 8. This pressure will—after being applied for some time—cause deformation in the telescopic profiles at the points b. In order to obtain the necessary bending stability of the telescopic profiles in order to resist the moment caused by the force F it is necessary to give the telescopic profiles a certain dimension c1 and c2. This dimension further enhances the production costs of the telescopic profiles on account of the demand for the fine tolerances mutually between the telescopic profiles If it is taken for granted that the two telescopic profiles in FIGS. 9, 10 and 11, 12 have the same bending stability, that the friction resistance between the profiles were the same, and that the clearance between them were the same, then the deflection in the point of attack of the force F would be the same. As it is not possible to obtain sufficient bending stability in the thin telescopic profiles in FIGS. 11 and 12 as that in the profiles shown in FIGS. 9 and 10, it is necessary to increase the dimensions in the telescopic profiles with the consequence of increased cost of materials. This greater dimension will at the same time give wider tolerances and consequently also increased tolerances between the telescopic profiles.

Figure 15:
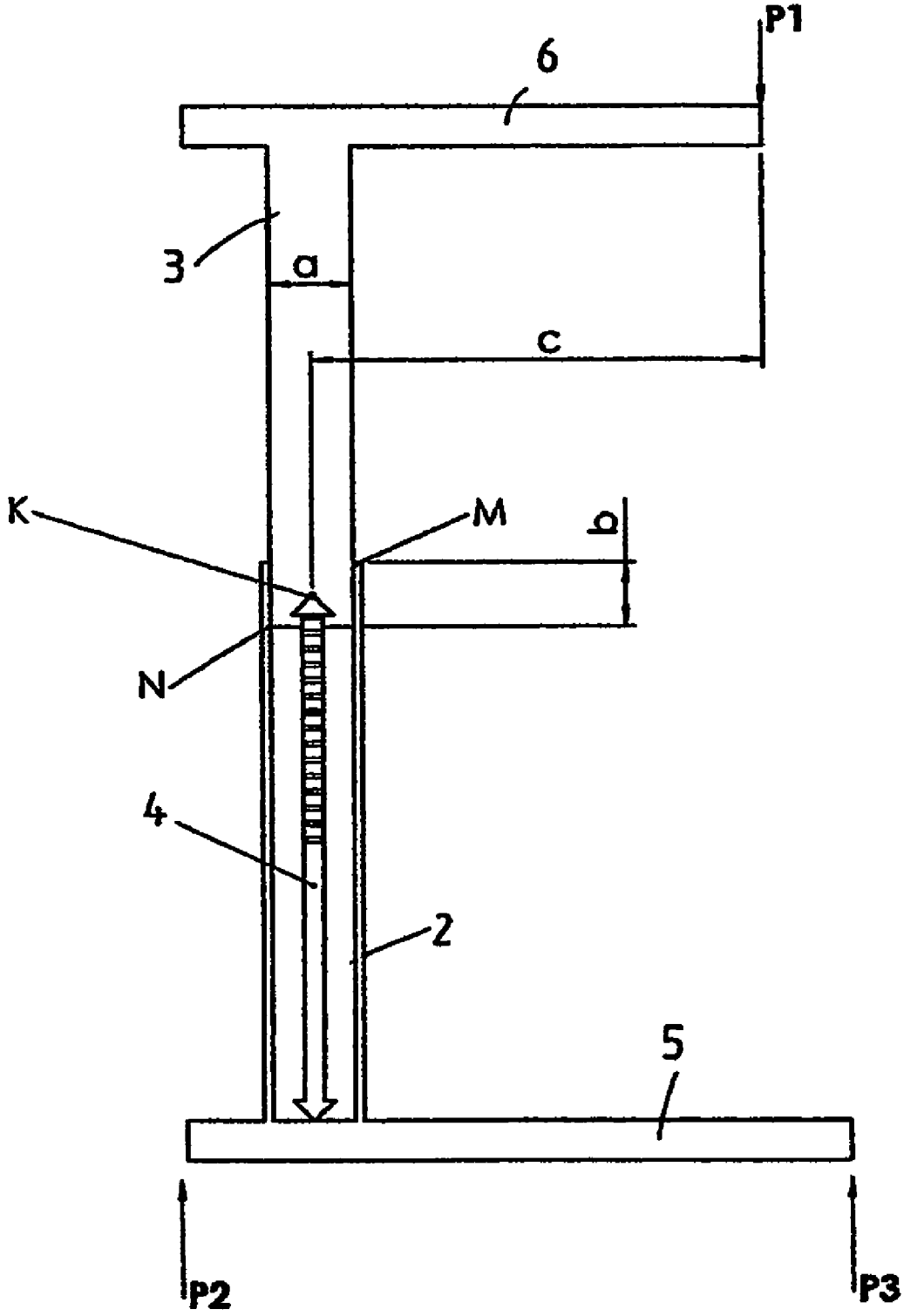
FIG. 15 shows a complete lifting column.
Figure 16:
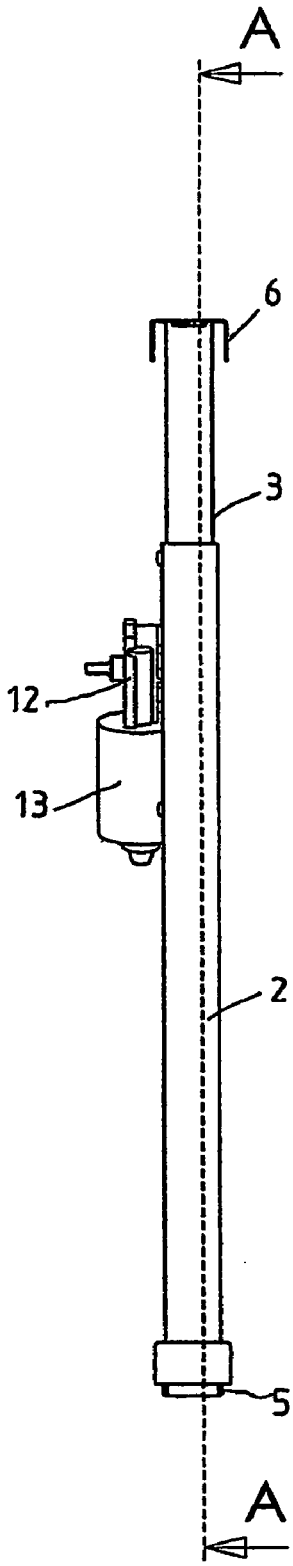
FIG. 16 is a side view of a telescopic lifting column according to the invention.

The two profiles are inserted into each other as shown in FIG. 15, and forces are applied as shown. The abutment K stems from a linear actuator 4. K absorbs forces only in the y direction. The overlap is defined by b and the width of the profiles by a. The profiles are thin-walled and are taken to be springy in the transverse direction.

Impact forces are taken up at the point K by the force P1, which in addition supplies a moment, which is counter-acted by forces at the points N and M. For the sake of convenience the point K is shown in the middle of the rectangle formed by a and b. In the case of a very short overlay b and with due attention paid to the clearance between the profiles, the latter would lose their grip.

The forces N and M are split up in x and y components. The forces in M and N, respectively, will pull and press in the profiles. The overlap b determines the size of the forces and the width of a their direction and thereby the distribution between the components.

If it is desirable to obtain the greatest possible height travel of a raising/lowering table and, if for reasons of economy, it is desirable to achieve this by means of an extensioner, it is a decisive factor that the overlap b is the least possible.

In the case of a given relationship between a and b, there will occur so much friction at the points N and M that the actuator in the downward direction must contribute an effort. This is normally not a problem, but it has the consequence that the actuator must be able to press at least twice the force P1 in order also to be able to lift.

In the case of another given relationship between a and b there will be a wedging effect between the profiles, when a load P is applied. The wedging effect is determined by the distances a, b, c, the force P, and the friction between the profiles, and the elasticity of the profiles. Exposure to a high force P will contribute to the fact that the actuator in K will not be able to start motion or must be unnecessarily high. With regard to all other parameters it is maintained that the wedging effect can be eliminated by a reduction of the distance a.

If it is desirable that the overlap between the profiles is small with regard to the travelling height, it is thus extremely important to have an infinitely short distance a. With the known technology this is not possible, as the profiles then would not be able to resist the bending moment coming from P1.

This problem can be solved by the present invention. By the invention the linear actuator, the preliminary linear control, the secondary linear control and the elements for bending stability are combined, so that they are all optimised to suit their purpose without counteracting interrelationships.

The fixed part of the table leg is mounted with a gear motor, which by means of a gear wheel pulls a toothed rack up and down. The toothed rack is fastened to the movable part of the table leg, so that these two parts can be taken as one element in every respect with regard to strength. The toothed rack is embodied with a narrow guide way of a width corresponding to the distance a mentioned above, which in relation to the load is a primary control. The fixed part of the table leg carries two guide pins at a distance corresponding to the above-mentioned distance b. Small tolerances between the guide pins and the guide way in the toothed rack is achieved at a lower price than in the case of the known technique For the secondary loads plastics sliders are embodied, which counteract wear and noise from diffuse applied loads, e.g. side loads. The plastics sliders can furthermore supplement the primary linear control, when the overlap b is great. The embodiment with plastics sliders is constructed so that sliding surfaces are not primarily visible and possible wear marks are not visible.

The construction can be embodied with one or more columns, here shown typically with two columns. The electric driving motor or mechanical spring system can be mounted in one leg and have mechanical transmission supplied to more than one column, or all legs can be supplied with a driving motor.

Figure 17:
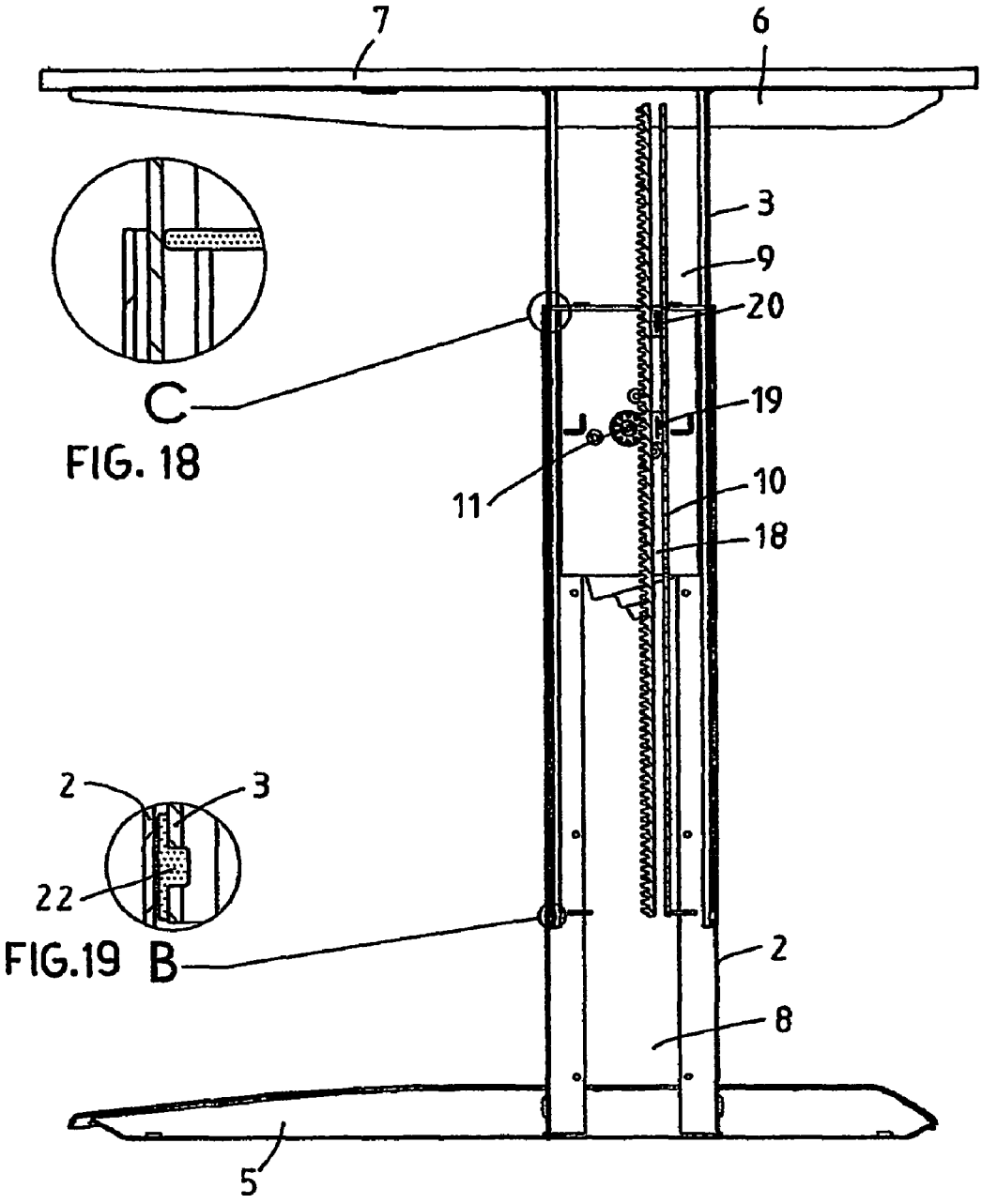
FIG. 17 shows a section after the line A-A in FIG. 16.
Figure 20:
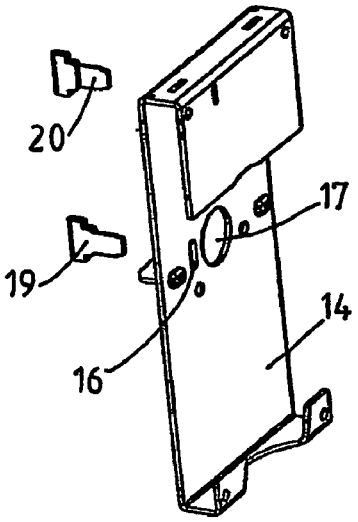
FIG. 20 is a perspective view of a mounting plate, which can be mounted on the external side at the top of the stationary part of a lifting column with two loose guide pins.
Figure 21:
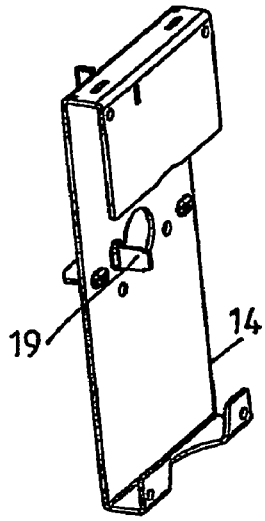
FIG. 21 is a picture corresponding to the one in FIG. 20 in which the guide pins are mounted and welded to the mounting plate.

As shown in FIG. 17 a table top 7, which can be lifted or lowered, is coupled to a sliding part 3 of a telescopic column. The part 3 is inserted down into a fixed part 2 of the lifting column. The part 2 is mounted on a transverse beam 5, which rests on the floor.

Figure 25:
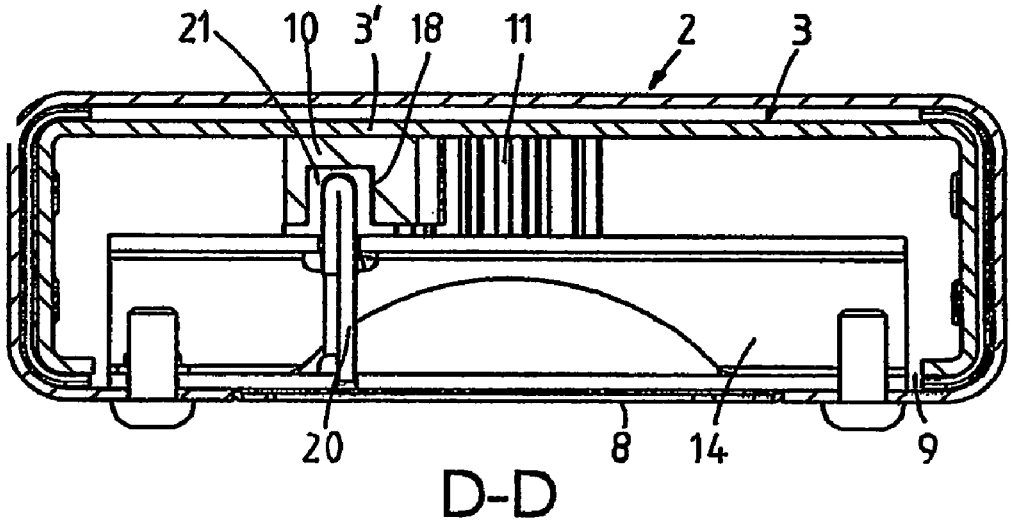
FIG. 25 shows a section after the line D-D in FIG. 24.
Figure 26:
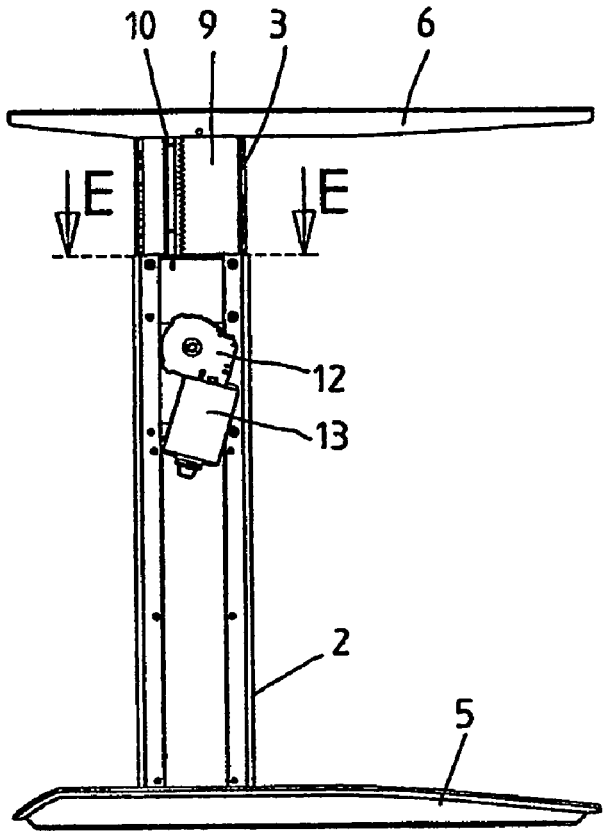
FIG. 26 shows a picture corresponding to the one in FIG. 24.

As shown in FIG. 25 the profiles 2 and 3 have a rectangular cross section, and they are mounted on the table top 7, so that the long sides are oriented transversely in relation to the longitudinal direction of the table top 7. In this way the profiles can take up the highest possible moment from the table top. One of the long sides in the profiles 2 and 3 have an open side, respectively 8 and 9, so that the profiles have a cross section roughly resembling a U. In their mounted position the open sides are turned towards the centre of the table.

Figure 22:
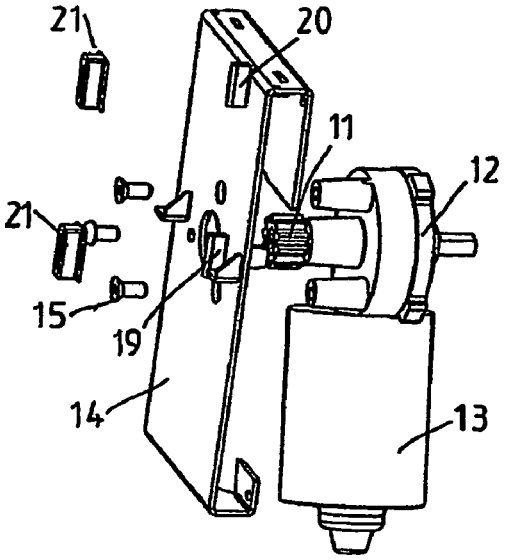
FIG. 22 is a perspective view of the mounting plate with mounted gear and gear motor in a position before being mounted in the mounting plate, and with two loose-fitting synthetic sleeves, which can slide in over the guide pins.
Figure 23:
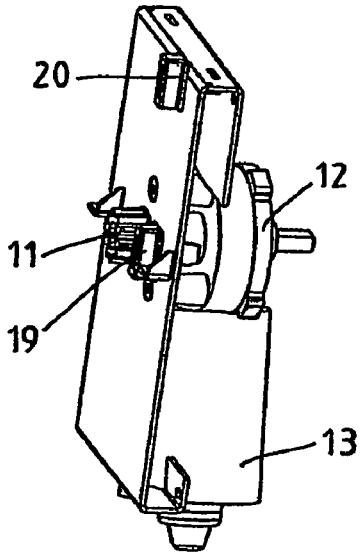
FIG. 23 shows the mounting plate mounted with gear and gear motor and synthetic sleeves.
Figure 24:
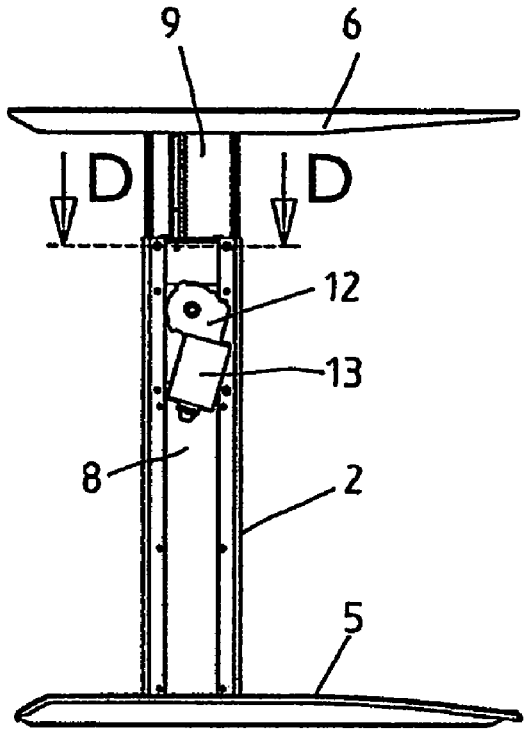
FIG. 24 shows a section in a table with a lifting column according to the invention seen from the internal side.

As shown in FIG. 25 the inside of the profile 3 has a toothed rack 10 fastened to the side wall 3' in the profile opposite the opening 9. As shown in FIGS. 17, 22 and 25 the toothed rack 10 is engaged in a gear wheel 11, which is coupled to a gear 12 and a motor 13, which is mounted on a mounting plate 14, which is fastened to the stationary profile 2 at the top, for example with screws 15. The toothed rack 10 is on the side opposite to the side 3' embodied with a longitudinal guide way 18, which as shown in FIGS. 17 and 25 mesh with two guide pins 19 and 20, which at the end which is carried into the guide way 18, is lined with a U-shaped sleeve 21 of a synthetic material. The guide pins 19 and 20 are fastened to the stationary part 2 of the lifting column.

The guide pins 19 and 20 are inserted in grooves 16 in the plate 14 and welded to it. The lowest guide pin 19 is—as shown in FIG. 17—located approximately opposite the toothed wheel 11. The toothed wheel 11 is during the mounting operation carried through an opening 17 in the plate 14.

Figure 27:
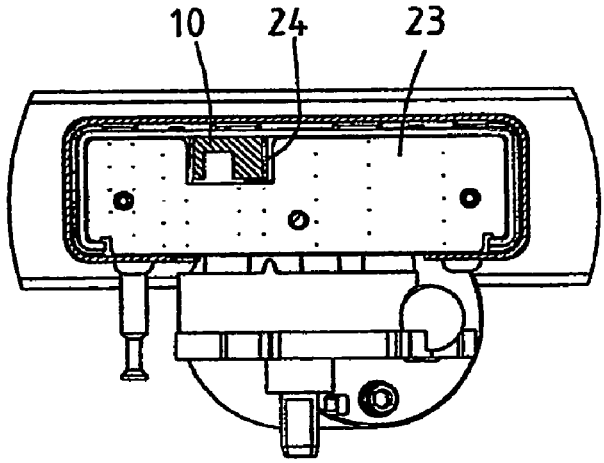
FIG. 27 shows a section after the line E-E in FIG. 26.
Figure 28:
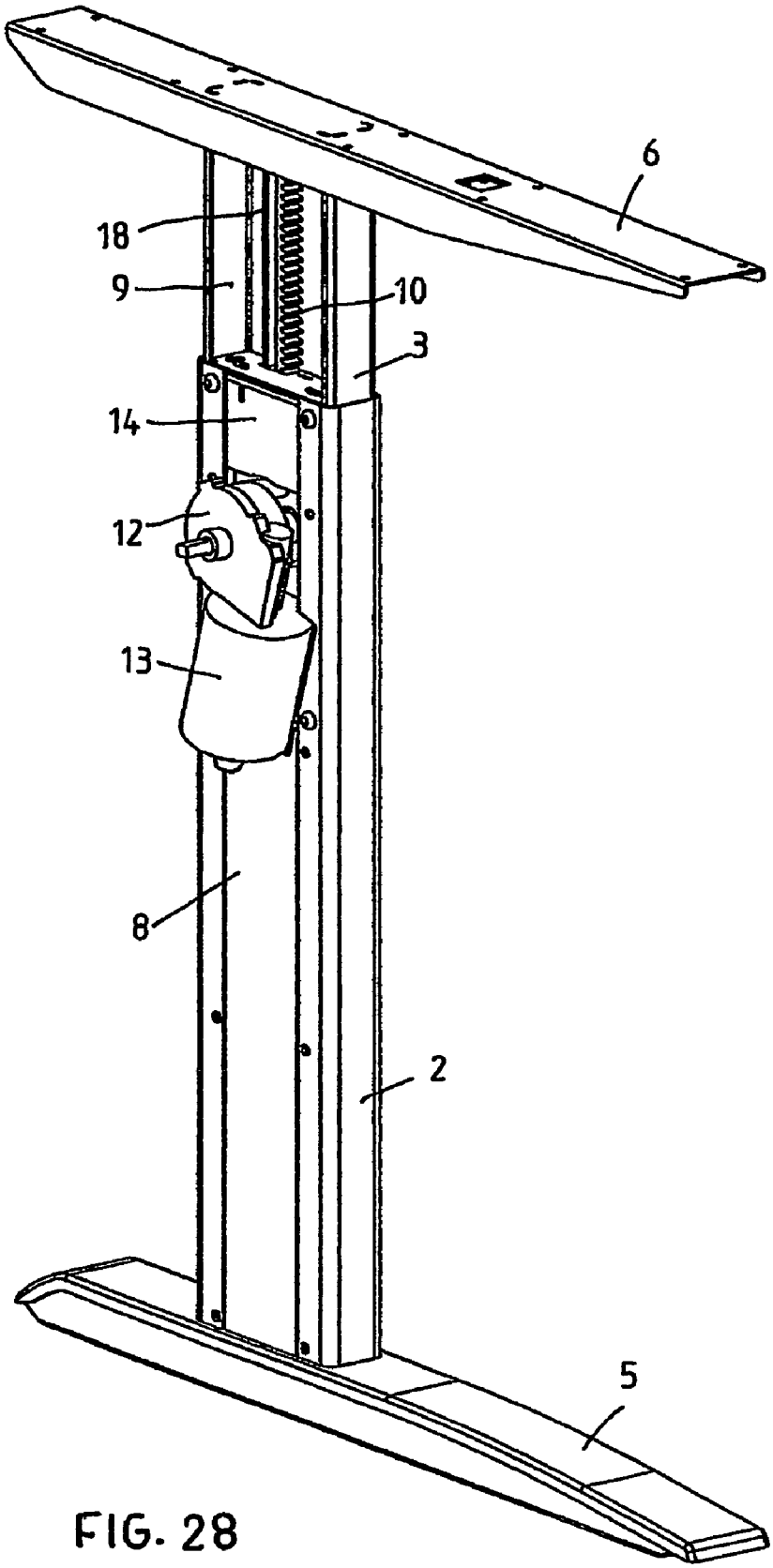
FIG. 28 is a perspective view of a lifting column according to the invention seen from the internal side.
Figure 29:
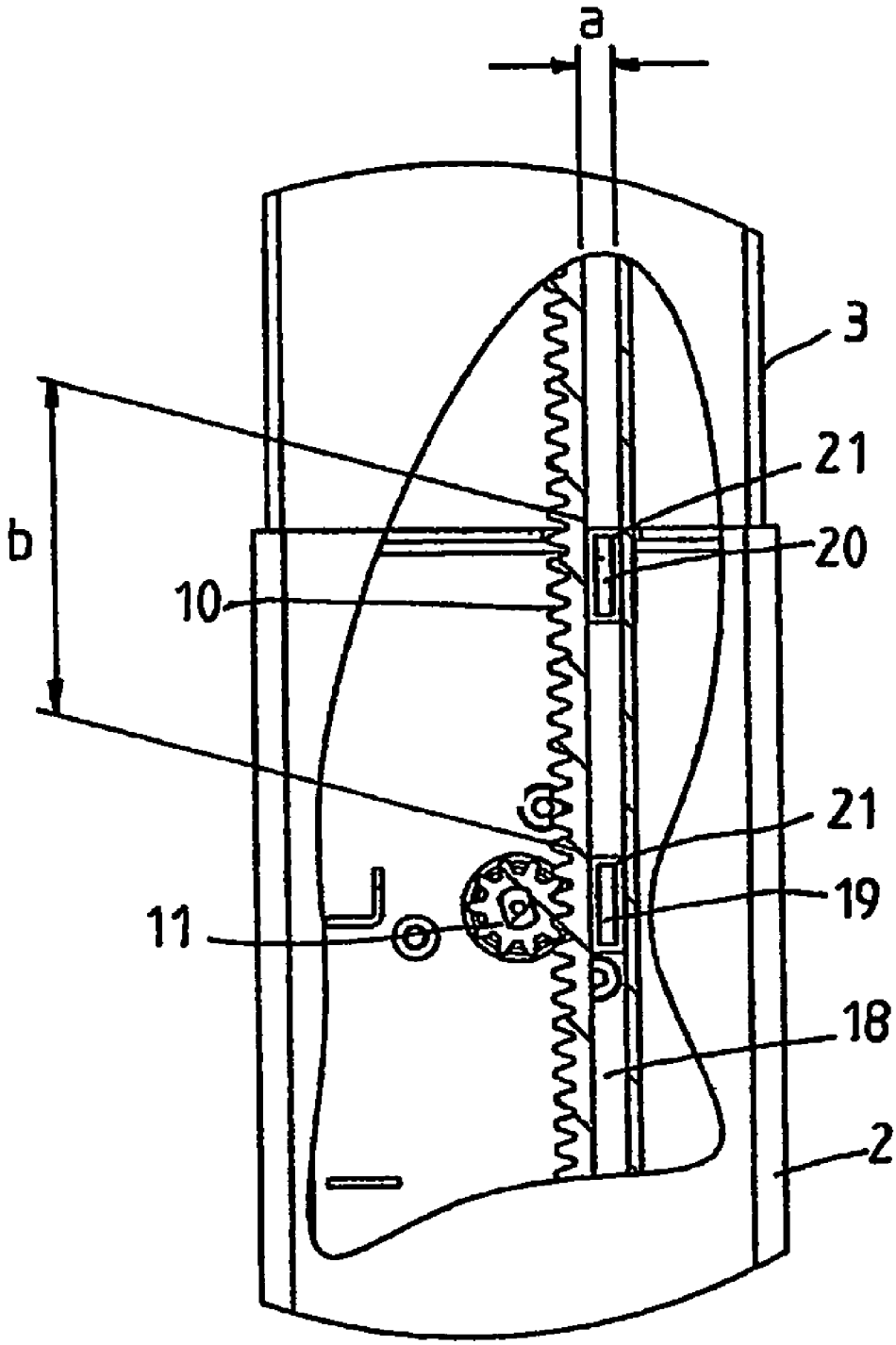
FIG. 29 is a larger scale view of a toothed rack for a lifting column according to the invention in mesh with a gear wheel and with two guide pins.

As shown in FIG. 17, the detail B is the movable part 3 of the lifting column at the bottom mounted with plastics slides 22, which rest against the internal side of the stationary part 2 of the lifting column and supplements the primary linear control from the guide pins 19 and 20, when the overlap b is long. As shown in detail C and in FIG. 27 the upper internal side in the stationary part 2 is mounted with a plate 23 of a synthetic material with an opening 24, which permits passage of the toothed rack 10.

On account of the narrow tolerance between the guide pins 19 and 20 and the guide way 18 of the toothed rack there is less friction between the movable part 3 and the stationary part 2, and no wedging effect occurs. Consequently, the motor needs not be very powerful, and the parts 2 and 3 can be of a more slight material, just as the tolerances need not be very narrow. The cost of production as well as of operation will therefore be lower than in the case of known lifting columns.

The invention claimed is:

1. A telescopic lifting column for height adjustment of an elevatable table having a table top, said lifting column comprising:

a stationary quadrangular profile having upper and lower ends and an internal width a, said lower end being coupled to a transverse beam;

a sliding quadrangular profile having upper and lower ends and an internal side wall; said sliding quadrangular profile being slidable relative to and within the stationary quadrangular profile;

a transverse beam connected to the table top and to the upper end of the sliding quadrangular profile;

a toothed rack fixedly mounted on the internal side wall of the sliding quadrangular profile;

a gear wheel coupled to a gear motor mounted on the stationary quadrangular profile;

wherein the stationary and sliding quadrangular profiles overlap for a distance b when the lifting column is in an extended position;

wherein the toothed rack is engaged in the gear wheel, such that the sliding quadrangular profile is raised and lowered relative to the stationary quadrangular profile by activation of the gear motor;

wherein the stationary and sliding quadrangular profiles each have an open side and an approximately U-shaped cross section;

wherein the toothed rack comprises a guide way having a width corresponding to internal width a of the stationary quadrangular profile;

wherein said guide way meshes with a pair of guide pins that are connected to the stationary quadrangular profile; and wherein a distance between said pair of guide pins corresponds to distance b of the overlap.

2. A telescopic lifting column according to claim 1, wherein the stationary and sliding quadrangular profiles each have a long side and a rectangular cross section; and wherein the open sides are present in the long side of the profiles; and wherein the telescopic lifting column is mounted with the long sides transverse to the longitudinal direction of the table, and with the open sides facing the centre of the table.

3. A telescopic lifting column according to claim 1, wherein the pair of guide pins are coated with a sleeve of synthetic material.

4. A telescopic lifting column according to claim 1, wherein one of the guide pins is located approximately opposite the gear wheel.

5. A telescopic lifting column according to claim 1, wherein the gear, the gear motor, and the guide pins are mounted on a plate which is fastened to the upper end of the stationary quadrangular profile.

6. A telescopic lifting column according to claim 1, further comprising slides mounted to the lower end of the sliding quadrangular profile, wherein said slides rest against an internal side wall of the stationary quadrangular profile.

7. A telescopic lifting column according to claim 6, wherein the slides are made of a plastic material.

8. A telescopic lifting column according to claim 1, wherein a plate having an opening is mounted to an internal surface of the stationary quadrangular profile at its upper end, wherein the opening receives the toothed rack.

9. A telescopic lifting column according to claim 8, wherein the plate is made of a synthetic material.

* * * * *